United States Patent [19]

Donnelly

[11] 3,957,472

[45] May 18, 1976

[54] CHEMICAL HEAT TRANSFER UNIT

[75] Inventor: William R. Donnelly, Piqua, Ohio

[73] Assignee: Readi Temp Inc., Piqua, Ohio

[22] Filed: June 10, 1975

[21] Appl. No.: 585,502

Related U.S. Application Data

[63] Continuation of Ser. No. 334,434, Feb. 21, 1973, abandoned, which is a continuation-in-part of Ser. No. 86,069, Nov. 2, 1970, abandoned.

[52] U.S. Cl. ..... 62/4

[51] Int. Cl.[2] ..... F25D 5/00

[58] Field of Search ..... 62/4

[56] References Cited

UNITED STATES PATENTS

| | | | |
|---|---|---|---|
| 1,894,775 | 1/1933 | Levenson | 62/4 |
| 2,907,173 | 10/1959 | Robbins | 62/4 |
| 3,191,392 | 6/1965 | Donnelly | 62/4 |
| 3,559,416 | 2/1971 | Cornwall | 62/4 |

FOREIGN PATENTS OR APPLICATIONS

| | | | |
|---|---|---|---|
| 580,807 | 8/1959 | Canada | 62/4 |

*Primary Examiner*—Norman Yudkoff
*Assistant Examiner*—H. H. Bernstein
*Attorney, Agent, or Firm*—Jerome P. Bloom

[57] ABSTRACT

A portable heat transfer unit in the form of a chemical package includes at least two chemical heat transfer materials separated by a chemical buffer material. In their dry state and in their separated condition the chemical heat transfer materials will remain inactive. The introduction of an activating fluid will cause the respective materials to individually and jointly react and interact to produce an extended heat transfer effect.

14 Claims, 1 Drawing Figure

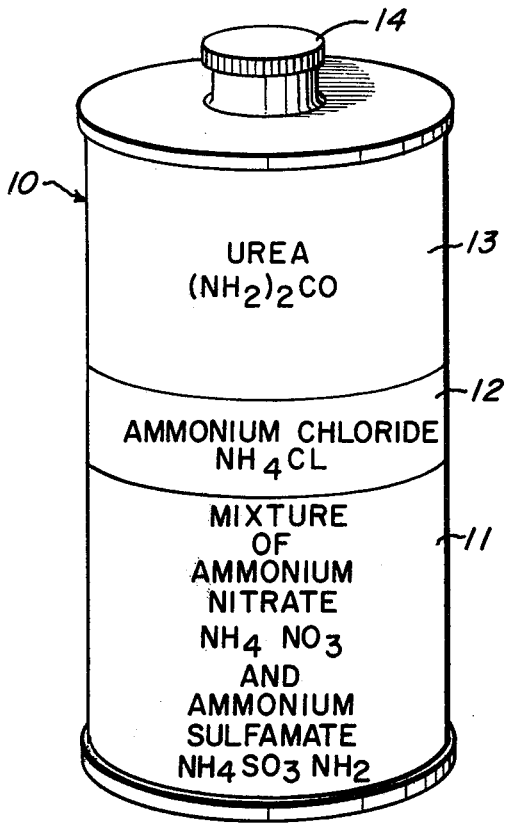
INVENTOR
WILLIAM R. DONNELLY
BY Jerome P. Bloom
ATTORNEY

CHEMICAL HEAT TRANSFER UNIT

This application is a continuation of applicant's co-pending application for United States Letters patent Ser. No. 334,434, filed Feb. 27, 1973 for "CHEMICAL HEAT TRANSFER UNIT", and now abandoned which application Ser. No. 334,434 is, in turn, a continuation-in-part of applicant's previously co-pending application for United States Letters patent Ser. No. 86,069, filed Nov. 2, 1970 for "CHEMICAL HEAT TRANSFER UNIT"and now abandoned.

BACKGROUND OF THE INVENTION

This invention relates to improvements in chemical packages serving as portable heat transfer units. It will be primarily described with reference to a unique package adapted to serve as a cooling device. However, it will be obvious that the invention embodiments are not so limited and such is not intended.

There have been many chemical packages and chemically activated devices proposed as portable heat transfer units in the prior art. However, they have had extremely limited acceptance. Their undesirable aspects have been many, two being of major importance. First, their shelf life has been extremely limited. Secondly, once energized, the period of their effective operation is normally inadequate to serve the intended purpose.

SUMMARY OF THE INVENTION

The present invention overcomes the above noted problems. It provides a chemical heat transfer unit featuring an improved portable package the contents of which do not deteriorate or become inoperable even though subjected to a long period of storage. The contents of such package are of such a nature and so arranged that the benefits of each constituent is fully retained and their total operating effect is greater than that of the sum of the individual parts, if such parts were separately used.

A primary object of the invention is to provide a portable heat transfer unit which is economical to fabricate, more efficient and satisfactory in use, adaptable to a wide variety of applications and unlikely to malfunction when activated.

A further object of the invention is to provide a novel heat transfer unit for use in connection with the preservation or preparation of other independently packaged materials.

A further object of the invention is to provide a convenient unitary heat transfer unit which may function independently of a conventional source of electricity or heat for the production of either heating or cooling effects.

A further object of the invention is to provide a means whereby one may take a packaged product from the shelf and in a simple manner change its temperature, for whatever use desired.

A further object of the invention is to provide an improved method of forming a package which imcorporates in an improved manner means for chemically inducing a change in the temperature of its contents so as to enable the use thereof as an effective heat transfer medium.

Another object of the invention is to provide a unique chemical package having long shelf life and a more effective use, when energized, to serve as a portable cooling unit.

A further object of the invention is to provide a novel portable heat transfer unit, possessing the advantageous features, the inherent meritorious characteristics and the means and mode of operation herein described.

With the above and other incidental objects in view, as will more fully appear in the specification, the invention intended to be protected by Letters Patent consists of the features of construction, the parts and combinations thereof and the mode of operation as hereinafter described or their equivalents.

DESCRIPTION OF A PREFERRED EMBODIMENT

Referring to the drawings the single figure thereof schematically illustrates a chemical package constituting a device in accordance with the invention. As here shown, the invention is primarily concerned with a heat transfer package constituting a cooling device. It provides a novel means and method for storing normally "incompatible" heat transfer chemicals in a single uncompartmented container in a manner to obviate the chance of their premature interaction, deterioration or decay, even during long periods of storage. The shelf life of the package is infinite. It is, moreover, capable of being simply activated by the addition of a readily available agent.

Referring now to the drawings, the constituents of the chemical package there shown are all introduced in the container 10 in a dry powder-like form. The container itself may be of any shape and may be made of any material which will readily pass heat.

The first constituent which is introduced in the container is a mixture of dry ammonium nitrate ($NH_4NO_3$) and ammonium sufamate ($NH_4SO_3NH_2$) forming a bottom layer 11. The proportion of the ingredients, by weight, is two parts of ammonium nitrate to one part of ammonium sulfamate. Let it be understood that this mixture has been heretofore disclosed in U.S. Pat. No. 3,191,392 issued June 29, 1965 to William R. Donnelly. Hence, it is not specifically claimed as being per se novel.

Next introduced in the container 10 to overlie the mixture of ammonium nitrate and ammonium sulfamate is a layer 12 of ammonium chloride ($NH_4CL$). The latter is in direct contact with the chemicals forming the layer 11. In this case the quantity of ammonium chloride is about a one half part by weight when compared to the quantity of the mixture therebelow.

To complete the dry package, superposed over layer 12 is a layer 13 of Urea $(NH_2)_2CO$. The amount of urea by weight equals that of the mixture of ammonium nitrate and ammonium sulfamate.

Thus, by weight, the container 10 holds 3 parts of layer 11, ½ part of layer 12, and 3 parts of layer 13. Moreover, the whole is a sandwich-type package arrangement wherein the successive ingredients or layers therof are in free and open contact with those adjacent.

All of the materials as originally applied are in this instance in a dry and basically powder-like form and the particles thereof are preferably coated with "Jaguar Plus", a Stein-Hall product. In lieu thereof the materals could be coated with calcium, clay or other types of absorbing powders since the purpose is to provide that there be on the constituents a moisture absorbent coating so there will be no free liquid if any moisture should exist in the container.

When the container is filled as described, a removable closure element is applied to create a sealed unit. The unit so provided is an extremely efficient portable heat transfer unit particularly designed for cooling purposes. The "Shelf life" of this package is for all practical purposes infinite since the particular materials specified, when packed in the manner disclosed, are not subject to deterioration or decay and are inhibited, inherently, from inter-action when in the specified dry form.

Considering the constituents of the described package in more detail, each of which, as pointed out, is in a dry state, the urea is a known cooling material, per se, as is the mixture of ammonium nitrate and ammonium sulfamate. However, urea in the dry state is incompatible with either ammonium nitrate or ammonium sulfamate in the dry state in that if brought into contact with either, under such conditions, an undesirable result is produced. The result of a direct dry contact is an immediate though rather slow reaction producing an acid which is neither a freezing nor a cooling mixture and therefore incapable of providing any effective heat transfer. If at all prolonged there is complete deterioration. Thus, though each by themselves provides a very satisfactory cooling medium, they cannot and have not previously been utilized jointly due to the results of their incompatibility, the nature of which is that if brought into contact in a dry state they interact in a manner as described to nullify their inherent capacity to absorb heat and produce a cooling effect. The present invention overcomes this problem and in so doing creates a package wherein the basic capabilities of the normally incompatible chemicals are safely retained and their combination to produce a more effective end result is created in a unique manner.

The invention package is achieved by the use of the specified buffer layer intermediate the dry urea and the dry mixture of ammonium nitrate and ammonium sulfamate. This buffer layer not only enables the long term storage of the constitutents of the package but when the package is activated it controls and regulates the intermixture of the chemical materials so as to enable a resultant highly efficient low temperature producing compound.

As noted, in the preferred embodiment illustrated ammonium chloride is used as the buffer of divider forming the intermediate layer 12. The ammonium chloride has per se a cooling capability when properly activated. Moreover, in the dry state specified it is compatible with both the urea and the mixture of ammonium nitrate and ammonium sulfamate in that it will not interact on contact therewith to cause deterioration or perceptible lessening of their potential to produce a cooling effect. For this reason during storage of the package constituents the ammonium chloride layer insures that there is no adverse condition obtaining within the container 10 which would result in either deterioration, decay or inter-action of the constituents. It is repeated and it is to be kept in mind that the constituents are stored in a "dry" state. Of course, nothing is ever completely free of moisture and in the particular arrangement provided the invention considers this fact. Not only are the particles of the constituents provided with a moisture absorbing coating but the ammonium chloride per se primarily absorbs any moisture in the container or the contacted material. As a result, the ammonium chloride layer 12 will in storage become rather stiff and sticky and form what might be considered a compacted wafer between the urea at the top and the mixture of chemicals in the bottom of the container. This wafer and basically the ammonium chloride thus provides a separating medium between the urea and other materials within the container which is positive in its effect to prevent premature reaction of the contained chemicals and thereby destruction and deterioration of the unit so as to disable it for the purpose intended. The obvious result is that the shelf life of the unit is infinitely extended.

When the user desires to activate the heat transfer unit it is only necessary to remove the closure from the container, introduce a liquid material, preferably ordinary water, reclose the container, and, in a very few minutes. the unit begins to chill as the contents ultimately becomes a freezing mixture. While the lowermost temperature the unit reaches will vary somewhat it will be in the area of 4°(F.) above zero. This cooling will continue for an appreciable length of time due to the presence of each of urea and the mixture of ammonium nitrate and ammonium sulfamate as well as the ammonium chloride and their gradual progressive and then combined action with the presence of water.

When the water is introduced it first begins to dissolve the urea which per se initiates the cooling action and then passes down to the wafer or buffer of the ammonium chloride which is likewise dissolved and its cooling effect is additive. The water then will drift into and activate the mixture of ammonium nitrate and ammonium sulfamate. With liquid present and converted to liquid state, the urea and the mixture of ammonium nitrate and ammonium sulfamate then become compatible in that they can then safely interact with reinforcing, rather than deterioration effect and produce an additive reaction and an extended cooling period. It is only in the dry state that the two materials are incompatible and produce an undesirable reaction if brought into contact with one another. Thus, as described, the heat transfer materials which are normally incompatible and thereby destructive of each other's heat transfer capabilities in the dry state are uniquely separated to maintain indefinitely a dry relatively inactive state. Merely upon the addition of water they provide an extremely effective combination producing a highly efficient heat transfer unit capable of extended cooling function to which the ammonium chloride contributes.

Particular attention is directed to the obvious fact that while urea and the mixture of ammonium nitrate and ammonium sulfamate are here specified as the normally incompatible coolant materials preferred in combination, there may be substituted therefor equivalent chemicals having similar physical properties and functional characteristics.

Of course, it is self-evident in the embodiment described that the originally dry constituents of the package are necessary soluble in the activating fluid which is added.

A most preferred embodiment of the invention found to have highly effective capabilities to serve as a cooling package utilizes a mixture of potassium nitrate and ammonium nitrate for the layer 11 rather than ammonium nitrate and ammonium sulfamate. For example, in producing a cooling package 10 formed to provide a jacket or receptacle for an 8 oz. beverage can, a highly effective composition of the respective layers, by weight, has been found to be as follows:

Layer 11 comprises a mixture of 20 grams of dry potassium nitrate and 110 grams of dry ammonium nitrate: buffer layer 12 comprises 40 grams of dry ammonium chloride: and layer 13 comprises 100 grams of dry urea.

Upon adding 150 to 190 grams of water to this dry package, there is an instantaneous reaction and interaction to produce an immediate chilling of the beverage can and its contents.

While not necessarily equivalent in capability other variations in the composition of the dry components of the layers 11 and/or 13 of the cooling package 10 have been tested and found to have good cooling capabilities when water is used as their activating agent. For example to provide the layer 11, rather than ammonium sulfamate or potassium nitrate one may mix with ammonium nitrate in its dry powdered form any one of the following chemicals in its dry powder form:

AMMONIUM BISULFATE
AMMONIUM BROMIDE
AMMONIUM BICARBONATE
AMMONIUM IODIDE
AMMONIUM MAGNESIUM SELENATE
AMMONIUM MAGANESE SULFATE
AMMONIUM PHOSPHATE DIBASIC
AMMONIUM POTASSIUM TARTRATE
AMMONIUM SALICYLATE
AMMONIUM SULFATE
AMMONIUM SODIUM SULFATE
AMMONIUM THIOCYONATE
AMMONIUM PERSULFATE
POTASSIUM PHOSPHATE
POTASSIUM SULFATE
POTASSIUM SODIUM TARTRATE
POTASSIUM THIOCYANATE
POTASSIUM IODIDE
POTASSIUM CHLORIDE

In combining any one of the last noted group of chemicals in various proportions with ammonium nitrate and with each in its dry powdered form, in absence of water or other activating liquid, there is no interaction therebetween or with the superposed buffer layer 12. However, on addition of water to the package there is an extended action and interaction thereof with capabilities produced of accommodating a rapid heat transfer and providing substantial cooling capacity.

Similarly, in providing the layer 13 of package 10 each of the following chemicals may be mixed in various proportion with urea with satisfactory results providing they are in a dry powder form:

AFENIL
SODIUM ACETATE
SODIUM CITRATE
SODIUM NITRATE
SODIUM THIOCYANATE
SODIUM THIOSULFATE
CITRIC ACID
TARTARIC ACID
FERRIC AMMONIUM SULFATE
THIOUREA

In any event in each cooling package the layers 11 and 13 have the characteristics that they cannot be brought into direct contact in the dry state without a reaction destructive of their capacity to serve as cooling chemicals. However, in the case of being solubilized by addition of a liquid activating agent the layers can interact to produce an extended and amplified cooling action on a contacted material.

Also in each package the proportions by weight of the various dry constituents may be varied to some degree with satisfactory results.

Similarly chemical equivalents may be substituted for the compatible ammonium chloride. The only criterion is that the materials have the capabilities and interrelate as described and with the specified end result. Of course more layers may be utilized in forming the invention package, provided a buffer material is inserted between adjacent incompatible materials and the buffer is compatible with the incompatible materials in the form in which they are packaged.

It has been found that when the dry materials of the respective layers are reduced to a powder the elements of which are microscopic their heat transfer capabilities when solubilized are even more enhanced and extended.

While the invention has been particularly described in reference to achieving a cooling package and this is the primary objective thereof, the invention is obviously not so limited. Utilizing the same basic concept, appropriate chemicals, normally incompatible in that they are destructive of each other's heat transfer capabilities on contact in one state, when separately introduced in such state into a container with a buffer medium therebetween may just as readily be of a nature to produce an exo-thermic reaction as an endo-thermic reaction when appropriately combined with water or other suitable material for activation. For example, to produce an exo-thermic reaction, it would be desirable that the layer 11 first introduced into the container 10 comprise exo-thermic material in the nature of a mixture of calcium oxide, sodium carbonate, and aluminum chloride, all in dry particle form. There would be superposed the layer 12 of a suitable and compatible moisture absorbent buffer material such as ammonium chloride, as in the instance first described. Layer 13 could then be calcium chloride or an equivalent exothermic material in a dry powder or like form, the latter being incompatible with the mixture of layer 11 in its dry form.

In this manner one can provide an exo-thermic package having initially separated chemicals which are normally incompatible, in the sense described, in the form in which they are introduced in the container 10. The key to the effectiveness of the heat transfer unit so provided is the utilization of the buffer material which not only primarily absorbs any moisture which might exist in the container 10 but inhibits reaction and interaction of the incompatible materials prior to introduction of an activating agent such as water. As will be obvious, once the container 10 is sealed in its dry form, one has a heat transfer unit having an extended shelf life. The unit so provided may be carried safely to any place of use without danger of deterioration. At the place of use, one can then introduce a liquidizing activating agent such as water, in which case there is a progressive reaction of the incompatible materials and a cumulative reaction therebetween as they become compatible in their liquidized form. Accordingly, the nature and function of the invention and its potential scope should be readily obvious.

The inventive concepts herein described may be embodied in yet another fashion. Utilizing again the two normally incompatible materials such as urea on the one hand and the mixture of ammonium nitrate and ammonium sulfamate on the other together with a compatible buffer material such as ammonium chloride, one may achieve a further cooling embodiment as follows. The total of the materials will be first introduced into a container or receptacle in their dry granular or powder form. Keep in mind that while the materials are dry, as mentioned previously, some moisture is always inherently present. The three constituents are introduced to their receptacle in this instance without care to maintain a sharp initial separation of the urea and mixture of ammonium nitrate and ammonium chloride. As a result, where there is contact initially between the incompatible chemicals, a slow wetting acid reaction will develop. As a result of the latter, after a relatively short interval, the incompatible materials together with the compatible ammonium chloride will tend to cake. At this point, this caked powder mixture is thoroughly beaten or whipped to a point where the ammonium chloride (or other equivalent compatible buffer chemical utilized) will achieve a dust-like form and will adhere to and coat primarily the powder-like particles of urea. This last occurs since the urea was permitted to become slightly moist by way of providing for the initial slight wetting action on contact between the incompatible chemicals. In this manner there is created a layer-like barrier of the buffer materials which interposes between the urea particles and the particles of the ammonium nitrate and ammonium sulfamate.

The thorough mixture of the named constituents so provided has been found to effectively produce, on introduction in a container 10 and sealing, a unique heat transfer package which will not readily deteriorate thereafter until the package seal is broken. Moreover, on introduction to this package of a wetting agent such as water, there will be produced reaction and interaction of the chemicals with benefits comparable to those of the first described cooling embodiment of the invention.

This last described embodiment of the invention refers to particular endo-thermic chemicals which are normally incompatible in the sense described in their dry form. Of course, as previously noted, the invention does not limit the chemicals which may be utilized. Chemicals having similar properties may be substituted. Also, by proper selection of exo-thermic chemicals, one can produce a heat transfer unit having the capability of serving to provide a substantial exo-thermic reaction.

It will of course be obvious that the package 10 here described may be fabricated in a variety of forms so as to enable it to nest or cup materials to be heated or cooled.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modification within the legitimate and valid scope of the appended claims.

I claim:

1. A heat transfer unit including a container, two chemical materials in said container in a particulate, dry inactive state, said materials being commonly adapted to be energized by the application of a liquid activating agent to produce heat transfer, and each said material characterized by the physical property of being destructive of the capacity of the other to provide heat transfer if there is contact therebetween in a dry state, a third material in said container, said third material being a dry particulate chemical material which is interposed to normally separate said heat transfer materials, said separating material being of a character which will not react with the adjacent heat transfer materials in a dry state, and said third chemical material having the characteristic of dissolving on addition of said activating agent to provide for communication of and a reinforcing interaction of said heat transfer materials in their energized liquid state, one of said heat transfer materials being chosen from the group consisting of: (1) ammonium nitrate in admixture with a compound chosen from the group consisting of ammonium sulfamate, potassium nitrate, ammonium bisulfate, ammonium bromide, ammonium bicarbonate, ammonium iodide, ammonium magnesium selenate, ammonium manganese sulfate, ammonium phosphate dibasic, ammonium potassium tartrate, ammonium salicylate, ammonium sulfate, ammonium sodium sulfate, ammonium thiocyanate, ammonium persulfate, potassium phosphate, potassium sulfate, potassium sodium tartrate, potassium thiocyanate, potassium iodide, and potassium chloride; and (2) a mixture of calcium oxide, sodium carbonate, and aluminum chloride; the other of said heat transfer materials being chosen from the group consisting of: (1) urea, urea in admixture with a compound chosen from the group consisting of afenil, sodium acetate, sodium citrate, sodium nitrate, sodium thiocyanate, sodium thiosulfate, citric acid, tartaric acid, ferric ammonium sulfate, and thiourea; and (2) calcium chloride; said group (1) of said one heat transfer material being used with said group (1) of said other heat transfer material, and said group (2) of said one heat transfer material being used with said group (2) of said other heat transfer material.

2. A unit as set forth in claim 1 characterized by said heat transfer materials being materials which on application of said activating agent will produce an endothermic reaction and which on contact with one another in a liquid state will produce an extended endothermic reaction.

3. A unit as set forth in claim 1 characterized by said heat transfer materials being materials which on application of said activating agent will produce an exo-thermic reaction and which on contact with one another in a liquid state will produce an extended exothermic reaction.

4. A unit as set forth in claim 1 characterized by at least a portion of said container being of material which will inherently pass heat.

5. A heat transfer unit as in claim 1 characterized by said third material having the physical property of absorbing free moisture which may exist within said container.

6. A heat transfer unit as in claim 1 characterized by said materials being commonly soluble so as to dissolve in water, on the application of which, as an activating agent, the materials react individually and mutually and produce an extended heat transfer effect.

7. A heat transfer unit as in claim 1 characterized by said chemical materials being stacked in said container in superposed layers and having a powder-like particle form, adjacent layers of said chemical heat transfer materials having interposed therebetween a layer of said separating material, which separating chemical material has the physical property to absorb free moisture in said container and thereby prevent premature reaction of said chemical heat transfer materials.

8. A heat transfer unit as in claim 1 characterized by said materials being included in a single compartment provided in said container, said two heat transfer materials being present in substantially equal parts by weight.

9. A heat transfer unit as set forth in claim 1 characterized by one of said heat transfer materials including urea and another of said heat transfer materials comprising ammonium nitrate and potassium nitrate and said third chemical material being ammonium chloride.

10. A heat transfer unit as set forth in claim 1 characterized by said third chemical material being a heat transfer material which is energized to produce a heat transfer effect by the application of said liquid activating agent.

11. A heat transfer unit as in claim 1 characterized by said three chemical materials including initially a mixture of urea and ammonium nitrate and ammonium sulfamate and, together therewith, ammonium chloride, producing thereby a slow wetting reaction therebetween to tend to cake the ammonium chloride, which mixture is thoroughly agitated to cause the ammonium chloride to adhere and coat, primarily, the urea which thereby separates the urea particles from the particles of ammonium nitrate and ammonium sulfamate.

12. A heat transfer unit as in claim 1 characterized by one of said heat transfer materials including urea being coated by said separating material which is a further heat transfer material and said second heat transfer material being thereby separated from said one heat transfer material.

13. A heat transfer unit including a container, three chemical materials in said container, two of which are heat transfer materials in an inactive state, said two heat transfer materials being incompatible in that direct contact therebetween in said inactive state will result in a reaction therebetween destructive of heat transfer capabilities, the third of said three chemical materials being positioned to separate and inhibit contact between said heat transfer materials as said materials are originally placed in their container and the said materials being commonly adapted to be energized by the introduction of an activating agent, whereupon said heat transfer materials are rendered capable of individually producing a heat transfer effect and coming together and interacting to produce an extended heat transfer effect and said third material is rendered capable of providing for the coming together of said heat transfer materials to enable such interaction, characterized by said two heat transfer materials being urea and a mixture of ammonium nitrate and ammonium sulfamate, said third material being ammonium chloride.

14. A heat transfer unit including a container, three chemical materials in said container, two of which are heat transfer materials in an inactive state, said two heat transfer materials being incompatible in that direct contact therebetween in said inactive state will result in a reaction therebetween destructive of heat transfer capabilities, the third of said three chemical materials being positioned to separate and inhibit contact between said heat transfer materials as said materials are originally placed in their container and the said materials being commonly adapted to be energized by the introduction of an activating agent, whereupon said heat transfer materials are rendered capable of individually producing a heat transfer effect and coming together and interacting to produce an extended heat transfer effect and said third material is rendered capable of providing for the coming together of said heat transfer materials to enable such interaction, characterized by one of said heat transfer materials being a mixture of calcium oxide, sodium carbonate and aluminum chloride, the other of said heat transfer materials being calcium chloride, and said separating material being ammonium chloride.

* * * * *

UNITED STATES PATENT AND TRADEMARK OFFICE

CERTIFICATE OF CORRECTION

PATENT NO. : 3,957,472

DATED : May 18, 1976

INVENTOR(S) : William R. Donnelly

It is certified that error appears in the above-identified patent and that said Letters Patent are hereby corrected as shown below:

Col. 1, line 5, "27" is corrected to read -- 21 --;

line 60, "imcor-" is corrected to read -- incor- --;

Col. 2, line 33, "sufamate" is corrected to read -- sulfamate --;

line 56, "therof" is corrected to read -- thereof --;

line 60, "materals" is corrected to read -- materials --;

Col. 3, line 43, "of" is corrected to read -- or --;

Col. 4, line 31, "deterioration" is corrected to read -- deteriorating --;

line 67, colon is changed to a semi-colon;

line 68, colon is changed to a semi-colon;

Col. 7, line 26, place quotes about -- dry --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*